US011414261B2

(12) United States Patent
Song et al.

(10) Patent No.: US 11,414,261 B2
(45) Date of Patent: Aug. 16, 2022

(54) COVER GLASS TRAY

(71) Applicant: Samsung Display Co., LTD., Yongin-si (KR)

(72) Inventors: Young Dae Song, Busan (KR); Eui Young Kim, Yongin-si (KR); Hong Ju Kim, Hwaseong-si (KR); Kyung Jo Lee, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/889,813

(22) Filed: Jun. 2, 2020

(65) Prior Publication Data

US 2021/0016957 A1 Jan. 21, 2021

(30) Foreign Application Priority Data

Jul. 18, 2019 (KR) ..... 10-2019-0086793

(51) Int. Cl.
*B65D 85/48* (2006.01)
*B65D 25/10* (2006.01)
*B65D 81/05* (2006.01)

(52) U.S. Cl.
CPC ..... *B65D 85/48* (2013.01); *B65D 25/103* (2013.01); *B65D 81/05* (2013.01)

(58) Field of Classification Search
CPC ..... B65D 81/05; B65D 85/48; B65D 25/103; B65D 25/107; B65D 25/108; B65D 25/10; B65D 81/053; B65D 81/133; B65D 25/005
USPC ..... 206/454, 448
See application file for complete search history.

(56) References Cited

U.S. PATENT DOCUMENTS

| | | | | |
|---|---|---|---|---|
| 8,777,007 | B2 | 7/2014 | Chen et al. | |
| 8,997,988 | B2 * | 4/2015 | Shi | B65D 5/48046 206/454 |
| 2005/0087470 | A1 * | 4/2005 | Chuang | B65D 43/0218 206/503 |
| 2011/0056868 | A1 * | 3/2011 | Ting | B65D 85/48 206/587 |
| 2013/0233759 | A1 * | 9/2013 | Chan | B65D 81/113 206/589 |

FOREIGN PATENT DOCUMENTS

KR 10-1896076 9/2018

* cited by examiner

*Primary Examiner* — Steven A. Reynolds
(74) *Attorney, Agent, or Firm* — H.C. Park & Associates, PLC

(57) ABSTRACT

A cover glass tray including a body portion having a lower surface, a first guide portion disposed on the lower surface of the body portion, a second guide portion spaced apart from the first guide portion, and a support portion disposed between the first guide portion and the second guide portion, and having one surface extending in a first direction, in which the first guide portion includes a first protrusion extending in the first direction and a first bent portion bent from one end of the first protrusion in a second direction different from the first direction, and the second guide portion includes a second protrusion extending in the first direction and a second bent portion bent from one end of the second protrusion in the second direction.

20 Claims, 12 Drawing Sheets

COVER GLASS TRAY

CROSS-REFERENCE TO RELATED APPLICATION

This application claims priority from and the benefit of Korean Patent Application No. 10-2019-0086793, filed on Jul. 18, 2019, which is hereby incorporated by reference for all purposes as if fully set forth herein.

BACKGROUND

Field

Exemplary embodiments of the invention relate generally to a cover glass tray, and more specifically, to a tray for packaging a cover glass having a curvature in at least one side thereof.

Discussion of the Background

Display devices are becoming increasingly important as multimedia develops. Accordingly, various types of display devices, such as an organic light emitting diode (OLED) display device or a liquid crystal display (LCD) device, are being used. Such display devices are applied to various applications, for example, mobile electronic devices, such as portable electronic devices including smart phones, smart watches, tablet PCs, and the like.

In various display devices used in mobile devices, a transparent cover glass is disposed at a front portion of a display panel, so that a user can see a display portion. The display panel may be divided into a display area where an image is actually displayed, and a non-display area defined by an area other than the display area. The cover glass may also be divided into a light-transmitting area corresponding to the display area, and an opaque light-blocking area corresponding to the non-display area according to the display panel. A light blocking member may be disposed on the opaque light-blocking area of the cover glass or a predetermined ink may be printed on the opaque light-blocking area of the cover glass to partially block light emitted from the display panel.

Recently, the importance of a display device having a display surface, in which some areas are inclined or rounded, is further increased. For example, a surface of a front cover glass forming the outer appearance of the display device may be partially rounded to improve the aesthetics of the display device and the grip comfort of the user.

The above information disclosed in this Background section is only for understanding of the background of the inventive concepts, and, therefore, it may contain information that does not constitute prior art.

SUMMARY

Trays constructed according to exemplary embodiments of the invention are capable of transporting or storing a cover glass having a curvature in at least one side thereof.

Exemplary embodiments also provide a cover glass tray, which can prevent a printed layer formed on one surface of the cover glass from being damaged.

Additional features of the inventive concepts will be set forth in the description which follows, and in part will be apparent from the description, or may be learned by practice of the inventive concepts.

A cover glass tray according to an exemplary embodiment includes a body portion having a lower surface, a first guide portion disposed on the lower surface of the body portion, a second guide portion spaced apart from the first guide portion, and a support portion disposed between the first guide portion and the second guide portion, and having one surface extending in a first direction, in which the first guide portion includes a first protrusion extending in the first direction and a first bent portion bent from one end of the first protrusion in a second direction different from the first direction, and the second guide portion includes a second protrusion extending in the first direction and a second bent portion bent from one end of the second protrusion in the second direction.

An upper surface of each of the first and second protrusions may be spaced apart from a reference line extending from the one surface of the support portion.

An upper surface of each of the first and second bent portions may be positioned on the same line as the reference line.

An upper surface of each of the first and second bent portions may be spaced apart from the reference line.

The support portion may include a first support portion and a second support portion spaced apart from each other along the second direction, and a first interval between the first support portion and the second support portion may be less than a second interval between an upper surface of the first bent portion and the upper surface of the first protrusion.

The first support portion and the second support portion may define a receiving area therebetween, and a cover glass having at least one bent side may be configured to be mounted in the receiving area.

The one bent side of the cover glass may be configured to be disposed above the first protrusion of the first guide portion to be spaced apart from the first protrusion.

The body portion may include an outer wall surrounding the lower surface, the outer wall may include a first outer wall and a third outer wall extending in the first direction, and a second outer wall and a fourth outer wall extending in the second direction, and the first protrusion of the first guide portion may be formed on the second outer wall.

The cover glass tray may further include a partition wall formed on the lower surface of the body portion and extending in the second direction between the second outer wall and the fourth outer wall, in which the second protrusion of the second guide portion may be formed on the partition wall.

The support portion may be formed in plural, each being disposed between the second outer wall and the partition wall, and between the partition wall and the fourth outer wall.

A cover glass tray on which a cover glass having at least one bent side is to be mounted according to another exemplary embodiment includes a body portion having a lower surface, and including a first outer wall formed on one side of the lower surface and extending in a first direction, a plurality of support portions arranged on the lower surface to be spaced apart from each other in the first direction, and a first guide portion including a first protrusion protruding from the first outer wall and a first bent portion bent from one end of the first protrusion, the first guide portion being spaced apart from the corresponding support portion, in which the cover glass is configured to be mounted between the plurality of support portions, such that the one bent side of the cover glass is positioned above the first protrusion of the first guide portion.

The one bent side of the cover glass may be configured to be positioned between the first outer wall and the first bent portion, while being spaced apart from the first protrusion.

The first bent portion may be spaced apart from the first outer wall, such that the cover glass is configured to be mounted with an interval between one side of the cover glass and the first outer wall less than an interval between the one side of the cover glass and the first bent portion.

The first bent portion may be spaced apart from the first outer wall, such that the cover glass is configured to be mounted with a printed layer disposed on a first surface of the one bent side of the cover glass facing the first bent portion while being spaced apart from the first bent portion.

The first protrusion may be formed on the first outer wall, such that the cover glass is configured to be mounted with an interval between one side of the cover glass and the first protrusion greater than half of an interval between the plurality of support portions.

The first bent portion may be bent from the one end of the first protrusion, such that the cover glass is configured to be mounted with an interval between an upper surface of the first protrusion of the first guide portion and an upper surface of the first bent portion greater than a width of a bent portion of the one bent side of the cover glass.

The cover glass tray may further include a second outer wall disposed on the lower surface of the body portion and extending in the first direction, and a second guide portion spaced apart from the corresponding support portion, and including a second protrusion protruding from the second outer wall and a second bent portion bent from one end of the second protrusion, in which the other bent side of the cover glass may be configured to be positioned above the second protrusion of the second guide portion.

The second bent portion may be spaced apart from the second outer wall, such that the cover glass is configured to be mounted with the other bent side thereof being spaced apart from the second protrusion and positioned between the second outer wall and the second bent portion.

The second bent portion may be spaced apart from the second outer wall, such that the cover glass is configured to be mounted with a printed layer disposed on a first surface of the other bent side of the cover glass facing the second bent portion while being spaced apart from the second bent portion.

The first bent portion of the first guide portion and the second bent portion of the second guide portion may be spaced apart from each other, such that an interval therebetween is less than a width between the one side and the other side of the cover glass.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
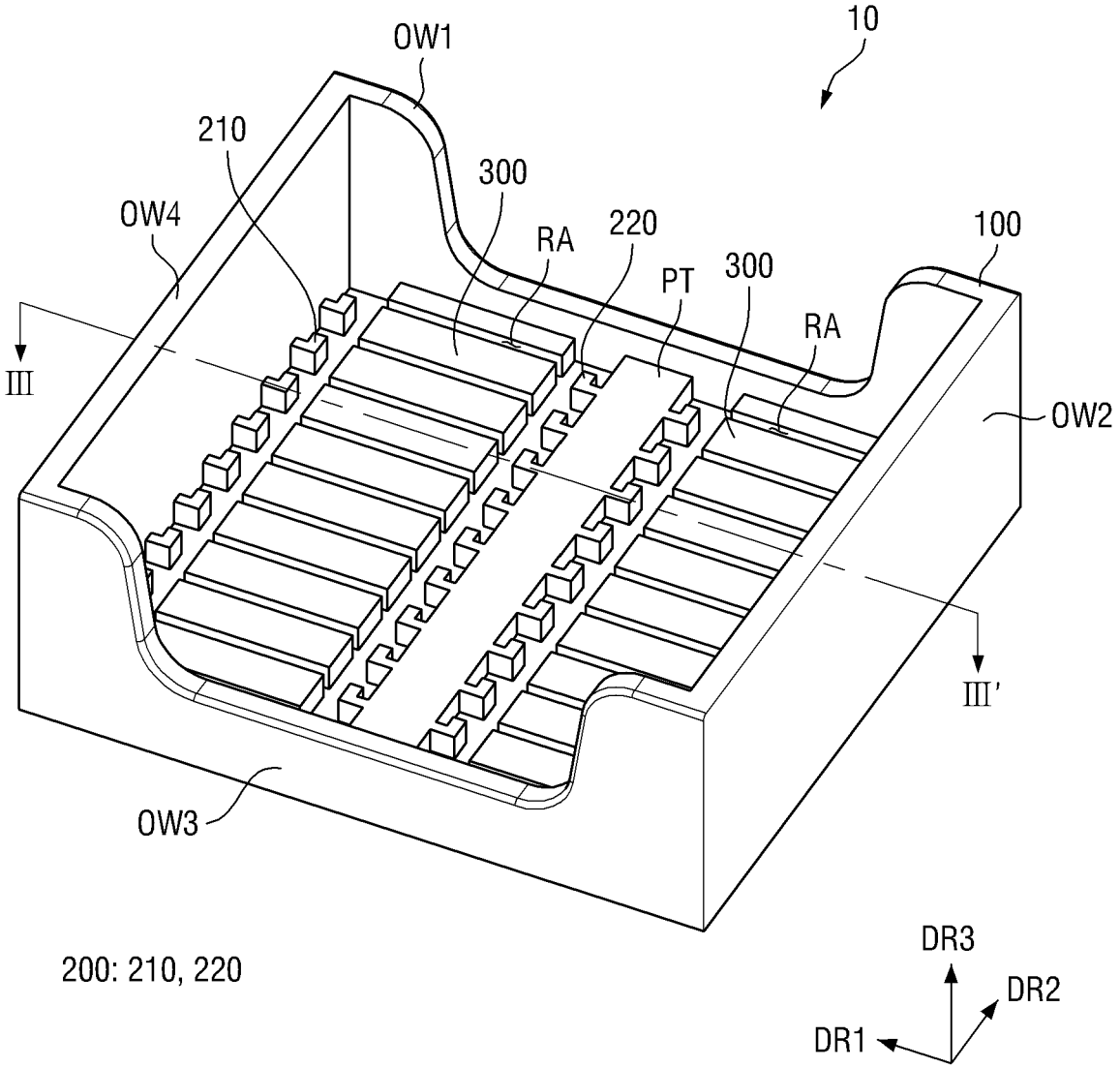
FIG. 1 is a perspective view of a cover glass tray according to an exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, exemplary embodiments will be described with reference to the accompanying drawings.

Figure 2:
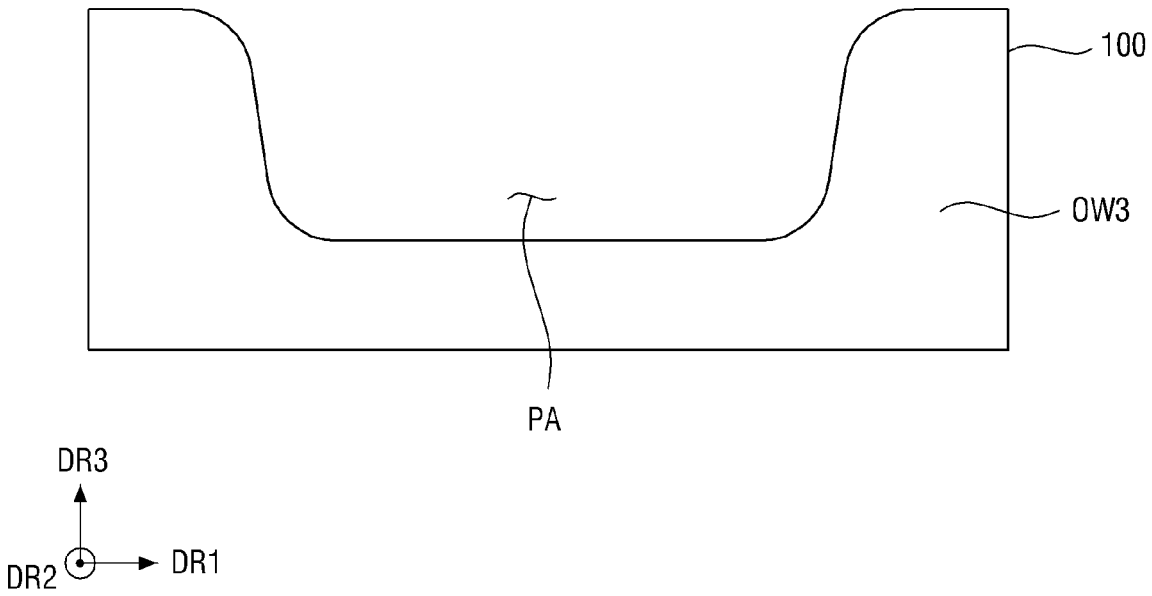
FIG. 2 is a schematic front view of the cover glass tray according to an exemplary embodiment.
Figure 3:
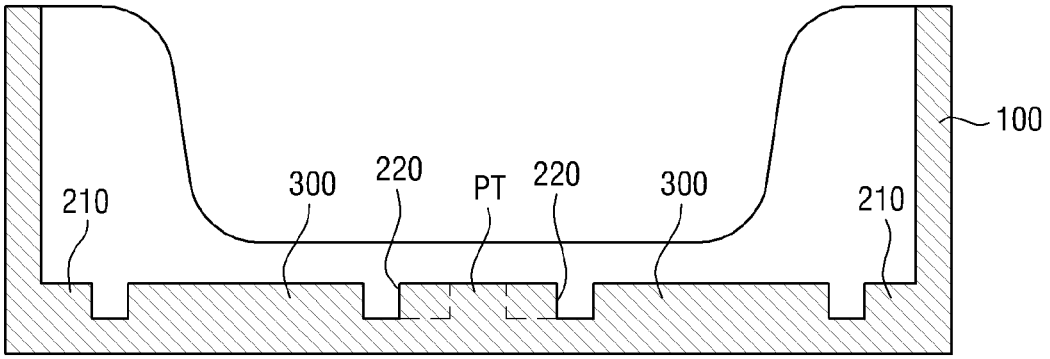
FIG. 3 is a cross-sectional view taken along line of FIG. 1.
Figure 3:
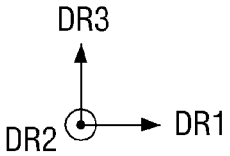
Figure 4:
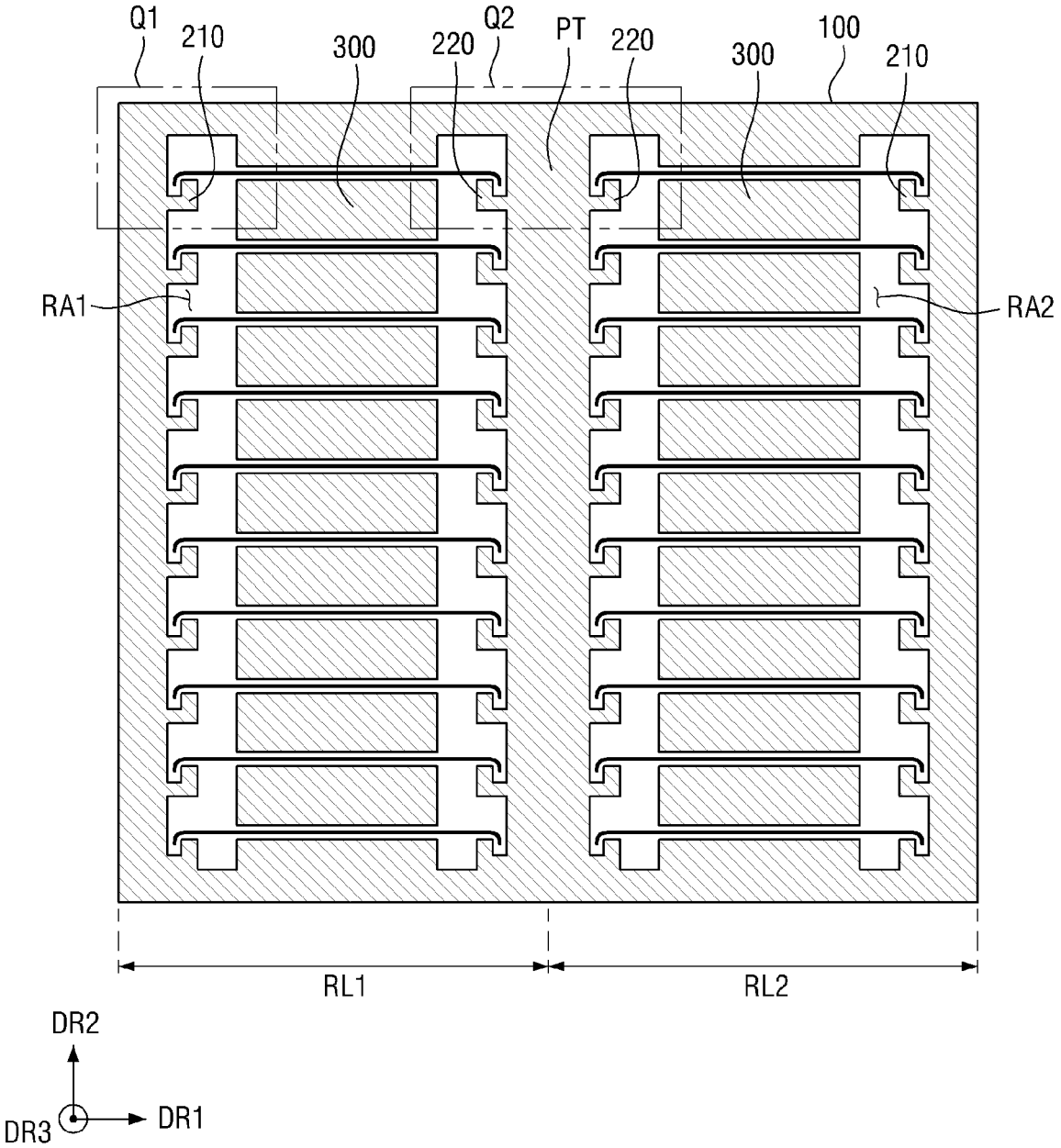
FIG. 4 is a schematic planar view of the cover glass tray according to an exemplary embodiment.

FIG. 1 is a perspective view of a cover glass tray according to an exemplary embodiment, FIG. 2 is a schematic front view of the cover glass tray according to an exemplary embodiment, FIG. 3 is a cross-sectional view taken along line of FIG. 1, and FIG. 4 is a schematic planar view of the cover glass tray according to an exemplary embodiment.

Referring to FIGS. 1 to 4, a cover glass tray 10 may include a body portion 100, a guide portion 200, and a support portion 300. The body portion 100 of the cover glass tray 10 may include a plurality of receiving areas RA, each of which may receive a cover glass 1000 (shown in FIG. 9), and the guide portion 200 may be disposed to face a part of the cover glass 1000 disposed in the receiving area RA. The guide portion 200 may guide the cover glass 1000, such that the cover glass 1000 can be stably mounted on the cover glass tray 10, or may prevent a portion of the cover glass 1000 from being damaged by an external impact.

The body portion 100 may have substantially a rectangular shape when viewed in a plan view. For example, as shown in FIG. 1, a lower surface of the body portion 100 may have substantially a rectangular planar shape having a long side in a first direction DR1 and a short side in a second direction DR2. A corner, where the long side in the first direction DR1 meets the short side in the second direction DR2, may be formed at right angles or may be rounded to have a predetermined curvature. However, the inventive concepts are not limited to a particular shape of the body portion 100, and in some exemplary embodiments, the body portion 100 may have substantially a polygonal, circular, or elliptical shape. In particular, the body portion 100 may have various shapes according to the shape of the cover glass 1000 to be mounted in the receiving area RA formed by the guide portion 200.

The body portion 100 may include a plurality of outer walls OW. The guide portion 200 may be formed on the lower surface of the body portion 100, and the outer walls OW may surround the guide portion 200. A portion of the guide portion 200 may be formed on the outer wall OW of the body portion 100. In particular, a part of the guide portion 200 may be formed integrally with the lower surface and/or outer walls OW of the body portion 100.

The outer wall OW of the body portion 100 may have a predetermined height and thickness. The outer wall OW is formed on an outer peripheral portion of the lower surface of the body portion 100, and the height and thickness of the outer wall OW may vary depending on the number of the cover glasses 1000 to be stored in the cover glass tray 10. The outer wall OW may include a first outer wall OW1 and a third outer wall OW3 extending in the first direction DR1, and a second outer wall OW2 and a fourth outer wall OW4 extending in the second direction DR2. The outer walls OW extending in the same direction may be disposed to face each other. The guide portion 200 may be positioned in an area between the outer walls OW and a receiving area RA, on which the cover glass 1000 is to be mounted.

The cover glass 1000 may be mounted in the receiving area RA, where the guide portions 200 are formed, to be spaced apart from each other, and the outer wall OW of the body portion 100 may partially surround an outer surface of the cover glass 1000. The outer wall OW of the body portion 100 may have a height lower than the height of the cover glass 1000, such that the cover glass 1000 can be prevented from being separated between the guide portions 200, when the cover glass 1000 mounted in the receiving area RA is transported or stored.

Although the corner where the outer walls OW meet is shown as an angular shape in the drawings, however, the inventive concepts are not limited thereto, and in some exemplary embodiments, the corner may have a rounded shape. In addition, an area extending in one direction from each outer wall OW may be partially recessed, such that each outer wall OW may have a curved shape, without being limited thereto.

In some exemplary embodiments, at least some of the outer walls OW of the body portion 100 may have a planar surface due to an upper surface extending in one direction, and the remaining parts may have a curved shape due to an upper surface thereof being partially recessed. As shown in the drawing, upper surfaces of the second outer wall OW2 and the fourth outer wall OW4 may extend in one direction, such as in the second direction DR2 to form a planar surface, and upper surfaces of the first outer wall OW1 and the fourth outer wall OW4 may be partially recessed to have a curved shape. In particular, the first outer wall OW1 and the third outer wall OW3 may have partially different heights, and the area surrounded by the outer wall OW may be exposed through the first outer wall OW1 and the third outer wall OW3. As shown in FIGS. 2 and 3, when the cover glass tray 10 is viewed from the front, the upper surface of the third outer wall OW3 includes a recessed portion PA, which is partially recessed at the central portion. In this manner, the third outer wall OW3 may have a central portion having a lower profile than both sides thereof.

Since the outer wall OW of the body portion 100 partially includes the recessed portion PA, when the cover glass 1000 is detached from the cover glass tray 10, an external device may be coupled to the cover glass 1000 through the recessed portion PA of each of the first outer wall OW1 and the third outer wall OW3. As will be described in more detail below, the receiving area RA on which the cover glass 1000 is mounted may be arranged in the second direction DR2, along which the first outer wall OW1 and the third outer wall OW3 face each other, and the cover glasses 1000 mounted in the receiving area RA may also be mounted in the cover glass tray 10 in the second direction DR2. Since the recessed portions PA are formed in the first outer wall OW1 and the third outer wall OW3, the external device may easily approach the cover glass 1000 in the second direction DR2, and the cover glasses 1000 mounted in the second direction DR2 may be sequentially separated from the cover glass tray 10. However, the inventive concepts are not limited thereto, and the shape of the outer wall OW of the body portion 100 may be modified as needed.

The guide portion 200 may be formed inside the body portion 100. The guide portion 200 may be formed on the lower surface of the body portion 100, and be disposed to be partially spaced apart from each other. The guide portion 200 may include a first guide portion 210 and a second guide portion 220. A plurality of first guide portions 210, second guide portions 220, and support portions 300 may be included in the cover glass tray 10, and the receiving area RA, in which the cover glass 1000 is to be mounted, may be provided in an area where the first guide portions 210, the second guide portions 220, and the support portions 300 are spaced apart from each other.

The first guide portion 210 may be formed on the lower surface of the body portion 100, and may be formed on both lateral sides, more particularly, on inner sidewalls of the second outer wall OW2 and the fourth outer wall OW4. The first guide portion 210 may substantially have a shape protruding from the inner sidewalls of the second outer wall OW2 and the fourth outer wall OW4, and may have a structure integrated with the second outer wall OW2 and the fourth outer wall OW4. However, the inventive concepts are not limited thereto, and the first guide portion 210 may be formed on the lower surface of the body portion 100 as a separate member.

The cover glass tray 10 may include the plurality of first guide portions 210 protruding from the outer wall OW, and the plurality of first guide portions 210 may be spaced apart from each other along an extension direction of the outer wall OW. For example, as shown in FIG. 4, the first guide portions 210 may be formed on the inner sidewalls of the second outer wall OW2 and the fourth outer wall OW4, and may be arranged along the second direction DR2.

The second guide portion 220 may be formed on the lower surface of the body portion 100, and may be formed on a partition wall PT extending in the second direction DR2 from the center of the lower surface. The second guide portion 220 may have substantially the same shape as the first guide portion 210, and may have a symmetrical structure with respect to the first guide portion 210. More particularly, the second guide portion 220 may have a shape protruding from both sidewalls of the partition wall PT, and may have a structure integrated with the partition wall PT. However, the inventive concepts are not limited thereto, and the second guide portion 220 may be formed on the lower surface of the body portion 100 as a separate member.

The cover glass tray 10 may include the plurality of second guide portions 220 protruding from a partition wall PT extending in one direction, and the plurality of second guide portions 220 may be spaced apart from each other along the extension direction of the partition wall PT. For example, as shown in FIG. 4, the second guide portion 220 may be formed on both sidewalls of the partition wall PT and arranged along the second direction DR2. Accordingly, a plurality of receiving areas RA may be arranged along the direction, in which the first guide portions 210 and the second guide portions 220 are arranged.

The arrangement direction of the first guide portions 210 and the second guide portions 220 may not be limited to the direction shown in FIG. 4. For example, in some exemplary embodiments, the first guide portions 210 may be formed on the inner sidewalls of the first outer wall OW1 and the third outer wall OW3, and the partition wall PT on which the second guide portions 220 are formed may extend along the first direction DR1 from the lower surface of the body portion 100. However, as described above, the arrangement direction of the first guide portions 210 and the second guide portions 220 may be substantially the same as the arrangement direction of the receiving areas RA and the direction in which the plurality of cover glasses 1000 are to be sequentially mounted. The arrangement direction of the first guide portions 210 and the second guide portions 220 may correspond to the direction along which the outer walls OW formed with the recessed portions PA face each other, such that the cover glass 1000 can be easily separated. In particular, as shown in the drawings, since the recessed portions PA are formed in the first outer wall OW1 and the third outer wall OW3, the first guide portions 210 and the second guide portions 220 may be arranged in the second direction DR2, along which the first guide portions 210 and the second guide portions 220 face each other. In some exemplary embodiments, when the recessed portions PA are formed in the second outer wall OW2 and the fourth outer wall OW4, the first guide portions 210 and the second guide portions 220 may be arranged in the first direction DR1, along which the first guide portions 210 and the second guide portions 220 face each other.

The support portion 300 may be disposed between the first guide portion 210 and the second guide portion 220. A plurality of support portions 300 may be arranged on the lower surface of the body portion 100, and may be arranged along the second direction DR2 while being spaced apart from each other in the same manner as the first guide portions 210 and the second guide portions 220. One support portion 300 may be disposed corresponding to one first guide portion 210 and one second guide portion 220. The first guide portion 210, the second guide portion 220, and the support portion 300 may be arranged as a unit, and be arranged along the second direction DR2 on the lower surface of the body portion 100. The receiving area RA, in which the cover glass 1000 is to be mounted may be formed between two units of the first guide portion 210, the second guide portion 220, and the support portion 300.

The plurality of support portions 300 may be disposed between the second outer wall OW2 and the partition wall PT, and between the fourth outer wall OW4 and the partition wall PT. The plurality of support portions 300 may be arranged to be spaced apart from each other in the second direction DR2 between the second outer wall OW2 and the partition wall PT, and between the fourth outer wall OW4 and the partition wall PT. The receiving area RA, in which the cover glass 1000 is to be mounted, may be formed between the support portions 300. Accordingly, the receiving area RA may include a first receiving area RA1 positioned on a first row RL1 between the second outer wall OW2 and the partition wall PT, and a second receiving area RA2 positioned on a second row RL2 between the partition wall PT and the fourth outer wall OW4. The first receiving area RA1 and the second receiving area RA2 may be formed in an area, where the first guide portion 210, the second guide portion 220, and the support portion 300 are spaced apart from each other. The cover glass tray 10 may include the plurality of guide portions 200 to form the plurality of receiving areas RA, and the cover glass 1000 may be sequentially mounted in the arrangement direction of the plurality of receiving areas RA.

According to an exemplary embodiment, the cover glass 1000 may have a shape, in which at least one side is bent at a predetermined curvature. When the cover glass 1000 is mounted on the cover glass tray 10, the bent side of the cover glass 1000 may be mounted to face the first guide portion 210 or the second guide portion 220, and a planar surface of the cover glass 1000 may be mounted to face the support portion 300. The cover glass tray 10 may have a structure, in which the first guide portion 210 and the second guide portion 220 have shapes corresponding to one bent side of the cover glass 1000, such that the cover glass 1000 may be easily mounted in the receiving area RA and the external impact may be prevented from being transferred to the cover glass 1000. Further, the first guide portion 210 and the second guide portion 220 may have a structure capable of preventing a printed layer 1150 (shown in FIG. 8) formed on one surface of the cover glass 1000 from being in contact with other members. Hereinafter, the shape and structure of the guide portion 200 will be described in more detail with reference to other drawings.

Figure 5:
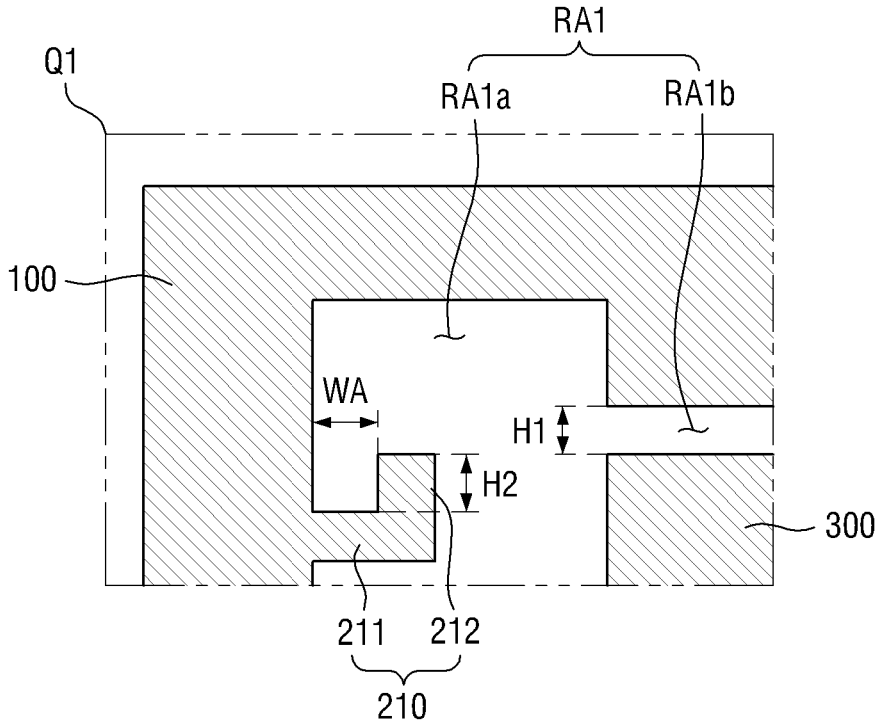
FIG. 5 is an enlarged view of a portion Q1 shown in FIG. 4.
Figure 6:
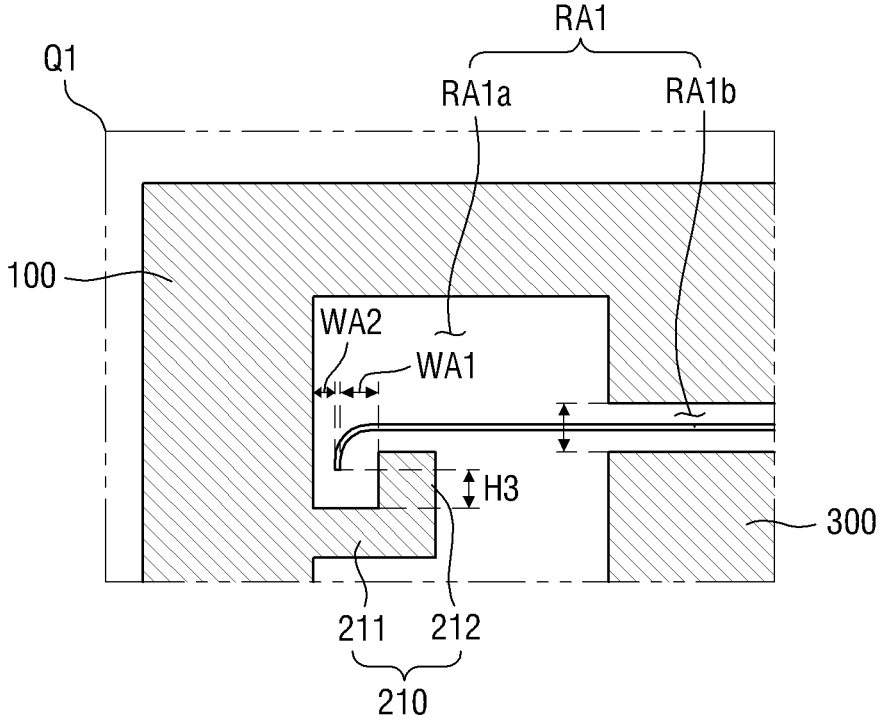
FIG. 6 is a schematic view partially illustrating a state in which a cover glass is mounted on the cover glass tray according to an exemplary embodiment.
Figure 7:
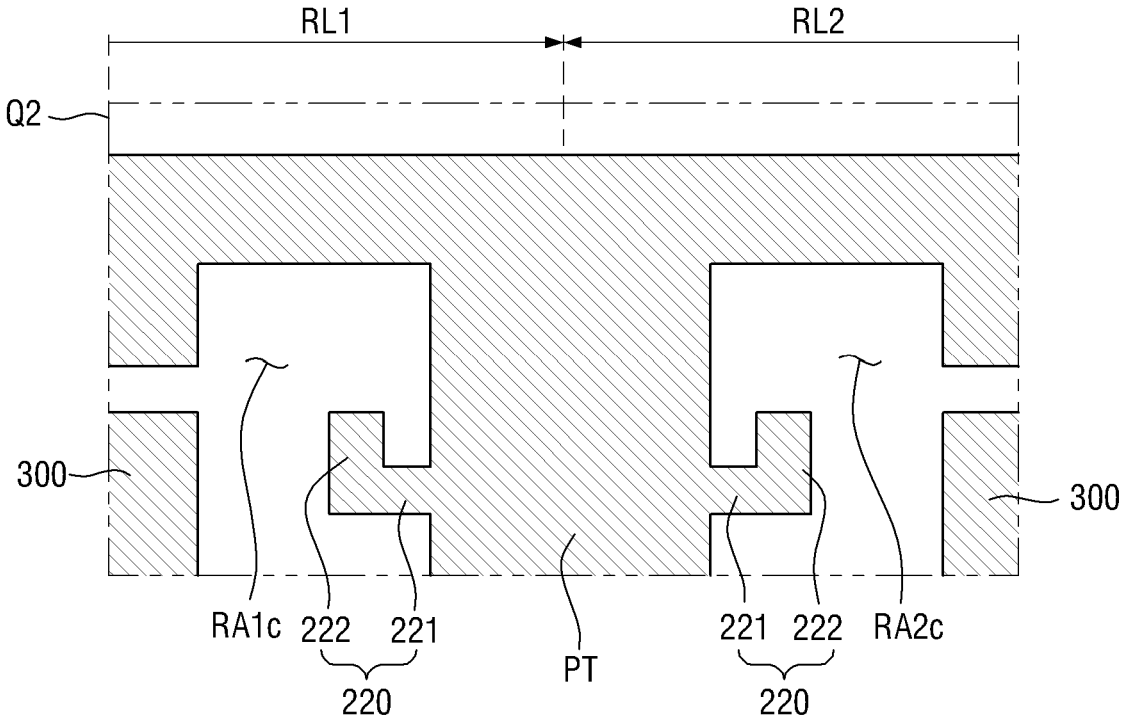
FIG. 7 is an enlarged view of a portion Q2 shown in FIG. 4.

FIG. 5 is an enlarged view of a portion Q1 shown in FIG. 4, FIG. 6 is a schematic view partially illustrating a state in which the cover glass is mounted on the cover glass tray according to an exemplary embodiment, and FIG. 7 is an enlarged view of a portion Q2 shown in FIG. 4. In particular, FIG. 5 is an enlarged view of a portion where the first guide portion 210 is formed, and FIG. 7 is an enlarged view of a portion where the second guide portion 220 is formed.

Referring to FIGS. 5 to 7 in association with FIG. 4, the first guide portion 210 and the second guide portion 220 may include protrusions 211 and 221 and bent portions 212 and 222, respectively. The first guide portion 210 may include the first protrusion 211 and the first bent portion 212, and the second guide portion 220 may include the second protrusion 221 and the second bent portion 222.

The first protrusion 211 of the first guide portion 210 may be formed on the outer wall OW of the body portion 100. As shown in the drawings, the plurality of first guide portions 210 may be formed on the second outer wall OW2 and the fourth outer wall OW4, and arranged along the second direction DR2, such that the first protrusion 211 of the first guide portion 210 may be formed on the second outer wall OW2 and the fourth outer wall OW4 along the second direction DR2. The first protrusion 211 may be a portion defined by a part of the outer wall OW2 protruding toward the inside of the body portion 100. The plurality of first protrusions 211 may protrude in the first direction DR1 from the outer wall OW, and may be spaced apart from other first protrusions 211 in the second direction DR2.

The first bent portion 212 of the first guide portion 210 may be a portion defined by an end of the first protrusion 211, which is bent in the second direction DR2. An upper surface of the first protrusion 211 and an upper surface of the first bent portion 212 may be spaced from each other as the first bent portion 212 is bent in a direction different from the extension direction of the first protrusion 211. A first sub-receiving area RA1*a* may be formed between the first guide portion 210 and the outer wall OW as the first bent portion 212 has a shape bent from the first protrusion 211. A second sub-receiving area RA1*b* is formed in a space between the support portions 300. As will be described below, one bent side of the cover glass 1000 may be positioned in the first sub-receiving area RA1*a*, and one planar surface of the cover glass 1000 may be positioned in the second sub-receiving area RA1*b*.

The second guide portion 220 may face the first guide portion 210 and may be formed symmetrically with the first guide portion 210. In particular, the second guide portion 220 may also include the second protrusion 221 and the second bent portion 222, and a third sub-receiving area RA1*c* may be provided between the outer wall OW or the partition wall PT and the second guide portion 220. The shapes of the second protrusion 221 and the second bent portion 222 of the second guide portion 220 may be substantially the same as those of the first guide portion 210, and thus, repeated descriptions thereof will be omitted to avoid redundancy.

According to an exemplary embodiment, the cover glass tray 10 may include the partition wall PT, which is formed on the lower surface of the body portion 100 and extends in the second direction DR2 between the second outer wall OW2 and the fourth outer wall OW4, and the second protrusion 221 of the second guide portion 220 may be formed on the partition wall PT. As the partition wall PT is formed, the receiving areas RA may be arranged in a plurality of rows RL in the cover glass tray 10. More particularly, since the support portions 300 are disposed between the second outer wall OW2 and the partition wall PT, and between the partition wall PT and the fourth outer wall OW4, the first receiving area RA1 and the second receiving area RA2 may be formed. The second guide portion 220 may be formed on the partition wall PT extending in one direction from the central portion of the body portion 100. The second guide portion 220 and the partition wall PT positioned in the first row RL1 and the second row RL2 may be integrally formed with each other, without being limited thereto.

The second protrusion 221 of the second guide portion 220 may be formed on the partition wall PT. As shown in the drawings, since the plurality of second guide portions 220 are formed on the partition wall PT and are arranged along the second direction DR2, the second protrusion 221 of the second guide portion 220 may be arranged in the second direction DR2 on the partition wall PT. A part of the partition wall PT may have a shape protruding toward the support portion 300. The plurality of second protrusions 221 may protrude in the first direction DR1 from the partition wall PT or the outer wall OW, and may be spaced apart from other second protrusions 221 in the second direction DR2.

The second bent portion 222 of the second guide portion 220 may be a portion defined by an end of the second protrusion 221, which is bent in the second direction DR2. An upper surface of the second protrusion 221 and an upper surface of the second bent portion 222 may be spaced apart from each other as the second bent portion 222 is bent in the direction different from the extension direction of the second protrusion 221. The third sub-receiving area RA1*c* may be formed between the second guide portion 220 and the partition wall PT as the second bent portion 222 has a shape, which is bent from the second protrusion 221. The other bent side of the cover glass 1000 may be positioned in the third sub-receiving area RA1*c*.

Since the cover glass 1000 mounted on the cover glass tray 10 has at least one bent side, the cover glass tray 10 according to an exemplary embodiment may include the guide portions 210 and 220 corresponding to one bent side of the cover glass 1000. The cover glass tray 10 may be provided with the first guide portion 210 including the first protrusion 211 and the first bent portion 212 in accordance with the shape of the one bent side of the cover glass 1000 to be mounted.

The cover glass 1000 according to an exemplary embodiment may include one planar surface and one bent side, which is bent in one direction from the one planar surface, and may be mounted in the receiving area RA of the cover glass tray 10. As shown in FIGS. 5 and 6, the cover glass 1000 may be mounted, such that the planar surface may be positioned in the second sub-receiving area RA1*b* which is defined by the support portions 300 spaced apart from each other, and the bent side may be positioned in the first sub-receiving area RA1*a* formed by the first guide portion 210.

The support portion 300 may form a planar surface that faces the planar surface of the cover glass 1000. A first interval H1 between the support portions 300 may be greater than a thickness of the cover glass 1000 to be mounted. The planar surface of the cover glass 1000 mounted on the cover glass tray 10 may come into contact with the support portion 300 during the transportation and storage. In this case, as will be described in more detail below, since protective layers 1200 and 1300 are disposed on the planar surface of the cover glass 1000, one surface of the cover glass 1000 may come into contact with the support portion 300.

The first guide portion 210 may face one bent side of the cover glass 1000. The first protrusion 211 and the first bent portion 212 of the first guide portion 210 may be formed according to the shape of one bent side of the cover glass 1000. The one bent side of the cover glass 1000 may be mounted while being spaced apart from the first protrusion 211 and the first bent portion 212.

According to an exemplary embodiment, the upper surface of the first protrusion 211 of the first guide portion 210 may be spaced apart from a reference line, on which one planar surface of the support portion 300 extends. As described above, the one planar surface of the mounted cover glass 1000 may be positioned in the second sub-receiving area RA1*b* defined by the support portions 300 spaced apart from each other. The one bent side of the cover glass 1000 may be spaced apart from the first guide portion 210, even if the one planar surface of the cover glass 1000, which is movably mounted on the cover glass tray 10, comes into contact with the support portion 300. As will be described below, a printed layer 1150 may be formed on the one bent side of the cover glass 1000. As such, the first guide portion 210 including the first protrusion 211 and the first bent portion 212 may have a width and height sufficient to be spaced apart from the one bent side of the mounted cover glass 1000.

According to an exemplary embodiment, a height H2 of the first bent portion 212 of the first guide portion 210, or a second interval between the upper surface of the first bent portion 212 and the upper surface of the first protrusion 211, may be greater than a first gap H1, which is an interval between the support portions 300. The one bent side of the cover glass 1000 movably mounted in the first receiving area RA1 may have a movement range corresponding to at least the first gap H1 between the support portions 300. The first protrusion 211 and the first bent portion 212 of the first guide portion 210 may face the one bent side of the cover glass 1000, and the first guide portion 210 may have a shape that can be spaced apart from the one bent side, even if the mounted cover glass 1000 comes into contact with the upper surface of the support portion 300. According to an exemplary embodiment, the height H2 of the first bent portion 212 of the first guide portion 210 may be greater than the first gap H1 between the support portions 300, and the cover glass 1000 may be mounted such that the one bent side can be spaced apart from the upper surface of the first protrusion 211 of the first guide portion 210. In some exemplary embodiments, an interval H3 between the one bent side of the cover glass 1000 and the first protrusion 211 may be greater than half of the gap H1 between the support portions 300 when the cover glass 1000 is mounted. In particular, the interval between the upper surface of the first bent portion 212 and the upper surface of the first protrusion 211, such as the height H2 of the first bent portion 212, may be greater than a width of a bent portion of the one bent side of the cover glass 1000.

In addition, according to an exemplary embodiment, the upper surface of the first bent portion 212 of the first guide portion 210 may be positioned on the same line as the reference line, on which one surface of the support portion 300 extends. The first bent portion 212 may have a predetermined height H2 and face the one bent side of the mounted cover glass 1000. In addition, the height H2 of the first bent portion 212 may have a range sufficient to maintain a distance from the mounted cover glass 1000. In some exemplary embodiments, the upper surface of the first bent portion 212 may be aligned on the same line as the reference line, on which the one surface of the support portion 300 extends, which may come into contact with one surface of the cover glass 1000. In this case, the first bent portion 212 may partially come into contact with the protective layers 1200 and 1300 of the cover glass 1000.

However, the inventive concepts are not limited thereto. In some exemplary embodiments, the first bent portion 212 may have a height H2, such that the first bent portion 212 may not come into contact with the mounted cover glass 1000. This will be described below with reference to other drawings. Various configurations of the first guide portion 210 described above may also be applied to the second guide portion 220, and thus, repeated descriptions thereof will be omitted.

The first bent portion 212 of the first guide portion 210 and the second bent portion 222 of the second guide portion 220 may be spaced apart from the one bent side and the other side of the mounted cover glass 1000. When the cover glass 1000 has a shape extending in one direction by a predetermined length and is mounted on the cover glass tray 10, the one bent side and the other side of the cover glass 1000 may be mounted while being spaced apart from the outer wall OW or the partition wall PT. The one bent side and the other side of the cover glass 1000 may be spaced apart from the first bent portion 212 of the first guide portion 210 and the second bent portion 222 of the second guide portion 220 while facing each other. For example, as illustrated in FIG. 5, the first bent portion 212 of the first guide portion 210 may be spaced apart from the outer wall OW of the body portion 100 by a predetermined distance. An interval WA between the first bent portion 212 and the outer wall OW may have a width sufficient to cause the one bent side and the first bent portion 212 to be spaced apart from each other when the cover glass 1000 is mounted. In the illustrated exemplary embodiment, an interval WA2 between one side of the cover glass 1000 and the outer wall OW may be less than the interval WA1 between the one side and the first bent portion 212.

When the cover glass 1000 is mounted on the cover glass tray 10, the one bent side may be positioned in the first sub-receiving area RA1*a* formed by the first guide portion 210, and the first bent portion 212 of the first bent portion 212 may be spaced apart from the one side of the cover glass 1000 while facing the one side of the cover glass 1000. When the interval WA2 between the one side of the cover glass 1000 and the outer wall OW is less than the interval WA1 between the one side and the first bent portion 212, an interval between the other side of the cover glass 1000 and the second bent portion 222 of the second guide portion 220 may be greater than an interval between the other side and the partition wall PT. In this manner, even if the cover glass 1000 mounted in the receiving area RA moves in one direction, since an interval WA2 between the one side of the cover glass 1000 and the outer wall OW (or an interval between the other side of the cover glass 1000 and the partition wall PT) is less than the interval WA1 between the one side of the cover glass 1000 and the first bent portion 212 (or an interval between the other side of the cover glass 1000 and the second bent portion 222), the one side and the other side of the cover glass 1000 may not come into contact with the first bent portion 212 and the second bent portion 222. In particular, the first bent portion 212 and the second bent portion 222 may be spaced apart from the outer wall OW and the partition wall PT, respectively, by a predetermined distance so that the cover glass 1000 may be mounted in the receiving area RA while having its one bent side and the other side spaced apart from the first guide portion 210 and the second guide portion 220, respectively. More particularly, according to an exemplary embodiment, a width between the one bent side and the other side of the cover glass 1000 may be greater than an interval between the first bent portion 212 of the first guide portion 210 and the second bent portion 222 of the second guide portion 220. Accordingly, it is possible to prevent the printed layer 1150 formed on one surface of each of the one bent side and the other side of the cover glass 1000 from being damaged.

Figure 8:
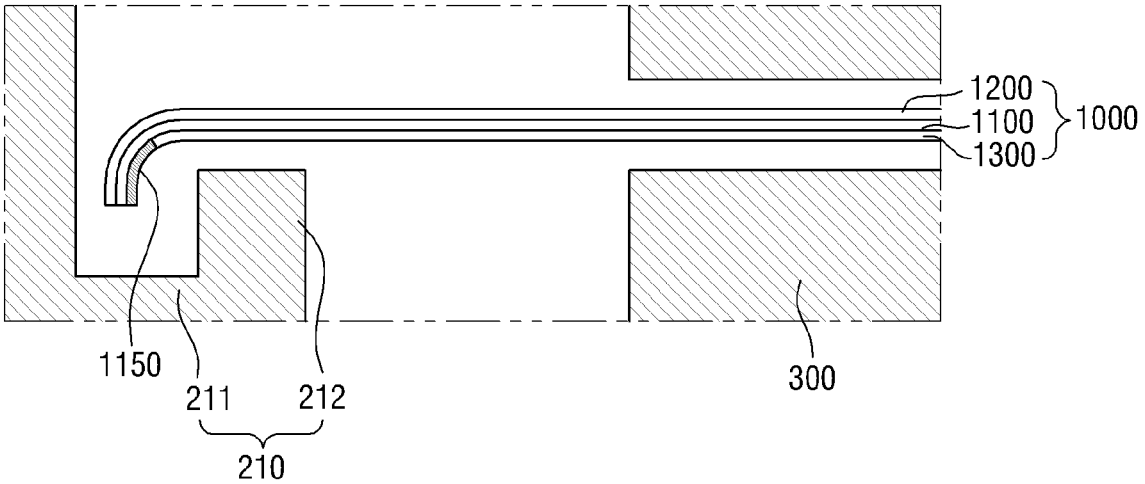
FIG. 8 is a schematic view partially illustrating a state in which a cover glass is mounted on a cover glass tray according to an exemplary embodiment.

FIG. 8 is a schematic view partially showing a state in which the cover glass is mounted on the cover glass tray according to an exemplary embodiment.

Referring to FIG. 8, the cover glass 1000 according to an exemplary embodiment may include a glass member 1100, a printed layer 1150 formed on one surface of the glass member 1100, and first and second protective layers 1200 and 1300 attached to the one surface and the other surface of the cover glass 1000. The cover glass 1000 may include one bent side and the other side, and the printed layer 1150 may be formed on one surface of each of the one bent side and the other side. The cover glass tray 10 may include the first guide portion 210 and the second guide portion 220 corresponding to the shapes of the one bent side and the other side to protect the printed layer 1150 of the cover glass 1000.

When the cover glass 1000 is mounted on the cover glass tray 10, the first protrusion 211 and the first bent portion 212 of the first guide portion 210 may be spaced apart from the one bent side of the cover glass 1000 while facing the one bent side of the cover glass 1000. The printed layer 1150 formed on one side of the cover glass 1000 may be spaced apart from the upper surface of the first protrusion 211 and one side surface of the first bent portion 212. The cover glass 1000 mounted on the cover glass tray 10 with a predetermined movement range may be mounted, such that at least the printed layer 1150 does not come into contact with the first guide portion 210.

The cover glass 1000 may include the first protective layer 1200 and the second protective layer 1300 attached to one surface and the other surface of the glass member 1100. The first protective layer 1200 and the second protective layer 1300 may protect the glass member 1100. As such, even when the cover glass 1000 is mounted with a predetermined movement range, since the outer wall OW of the cover glass tray 10, the support portion 300, and the first guide portion 210 come into contact with the first protective layer 1200 or the second protective layer 1300, the printed layer 1150 and the glass member 1100 may be protected. The cover glass tray 10 according to an exemplary embodiment may include the first guide portion 210 and the second guide portion 220 corresponding to the bent shape of the cover glass 1000 having at least one bent side so that the cover glass 1000 may be stably mounted. In addition, since the first guide portion 210 and the second guide portion 220 are formed in accordance with the bent shape of the cover glass 1000, the cover glass tray 10 may prevent the printed layer 1150 formed on the cover glass 1000 from being damaged.

The cover glass tray 10 according to one embodiment may include a plurality of receiving areas RA to mount a plurality of cover glasses 1000. Since the plurality of receiving areas RA are formed in a plurality of rows RL in the cover glass tray 10, the plurality of cover glasses 1000 may be mounted on the cover glass tray 10 while forming a plurality of rows.

Figure 9:
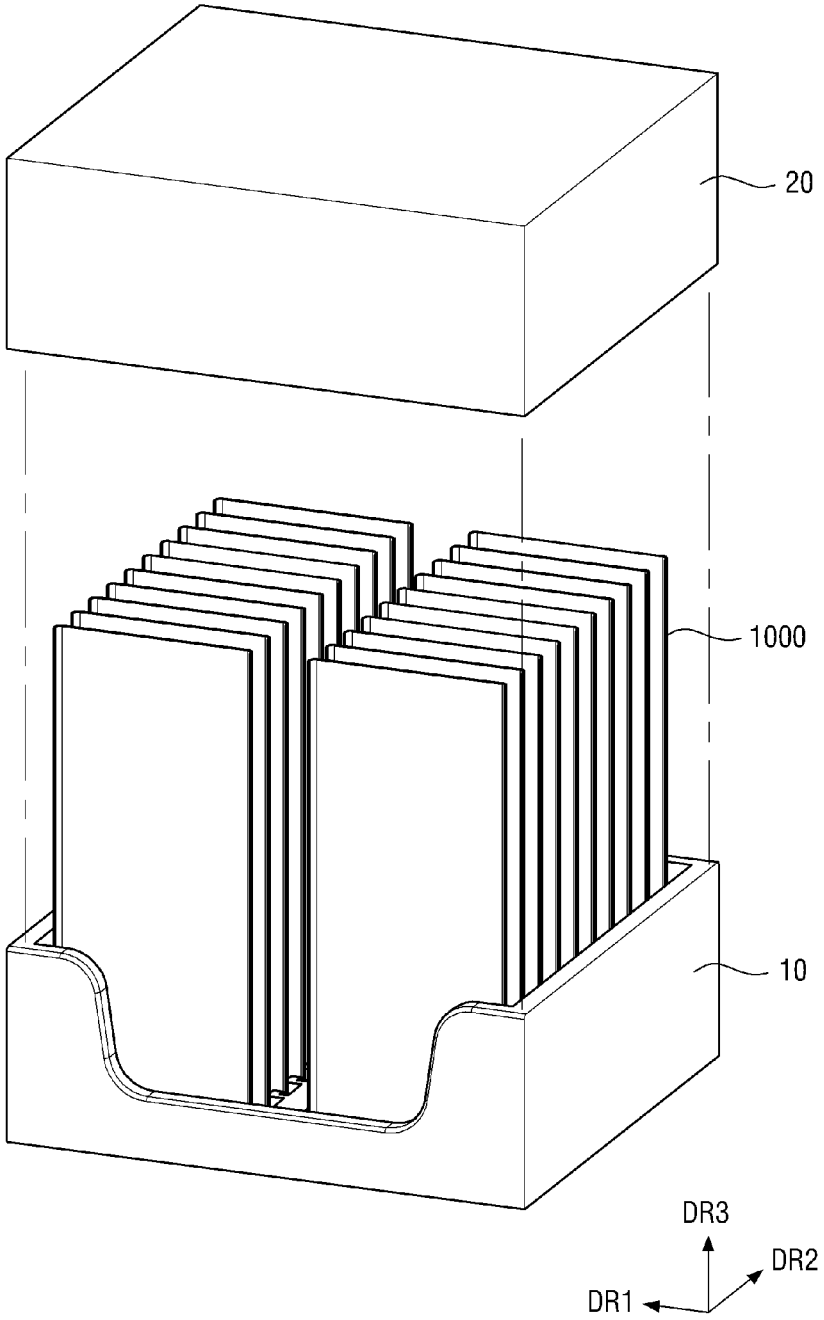
FIG. 9 is a schematic perspective view illustrating a state in which the cover glass is mounted on the cover glass tray according to an exemplary embodiment.

FIG. 9 is a schematic perspective view showing a state in which the cover glass is mounted on the cover glass tray according to one embodiment.

Referring to FIG. 9, according to an exemplary embodiment, the cover glass tray 10 may include a plurality of rows RL of receiving areas RA on which the cover glass 1000 is to be mounted, and may further include a cap portion 20 for protecting an exposed area of the mounted cover glass 1000. As described above, the body portion 100 of the cover glass tray 10 may include the outer wall OW having a predetermined height, and the height of the outer wall OW may be less than the length of the long side of the cover glass 1000. In this case, a part of the cover glass 1000 may be exposed when the cover glass 1000 is mounted on the cover glass tray 10. The cover glass tray 10 according to an exemplary embodiment may further include the cap portion 20 for protecting the cover glass 1000 mounted in the receiving area RA. In some exemplary embodiments, however, the cap portion 20 may be omitted.

Figure 10:
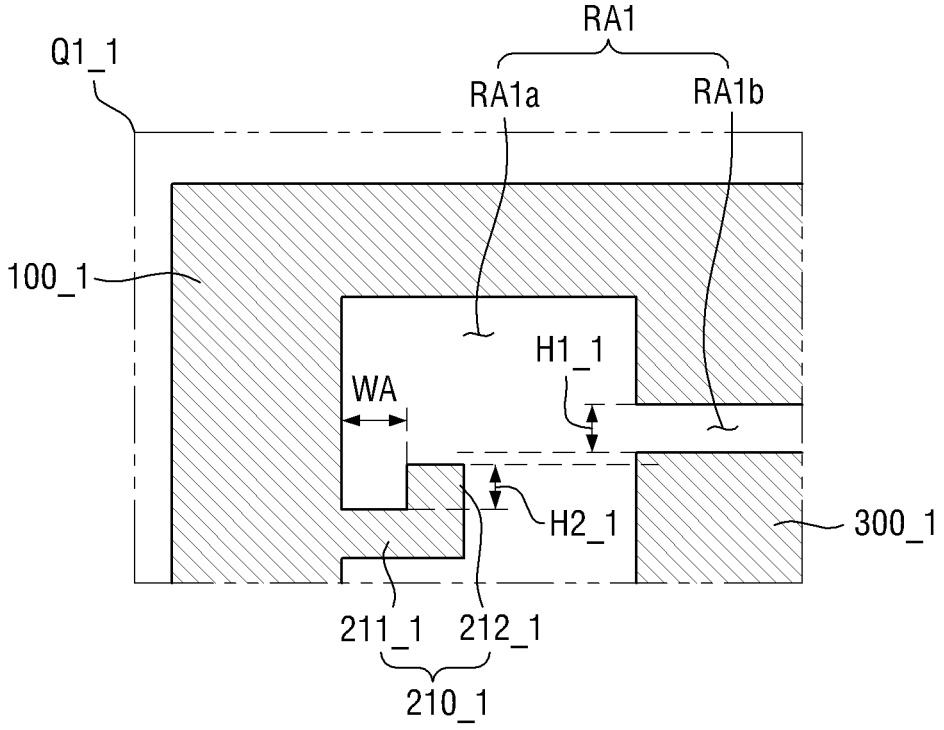
FIG. 10 is a partial enlarged view of a cover glass tray according to another exemplary embodiment.

FIG. 10 is a partial enlarged view of a cover glass tray according to another exemplary embodiment.

Referring to FIG. 10, an upper surface of a first bent portion 212_1 of a first guide portion 210_1 of a cover glass tray 10_1 according to the illustrated embodiment may be spaced apart from a reference line, on which one surface of a support portion 300_1 extends. The cover glass tray 10_1 according to the illustrated exemplary embodiment is different from that shown in FIG. 5 in terms of the shape of the first bent portion 212_1 or the second bent portion 222_1. Hereinafter, the following descriptions will be focused on the differences between the cover glass trays, and thus, repeated descriptions of substantially the same elements will be omitted.

The cover glass tray 10_1 shown in FIG. 10 may have a height H2_1 sufficient to prevent the first bent portion 212_1 from coming into contact with the mounted cover glass 1000. The upper surface of the first bent portion 212_1 of the first guide portion 210_1 may have a height H2_1 sufficient to be spaced apart from the reference line, on which one surface of the support portion 300_1 extends. When the cover glass 1000 is mounted, one bent side is positioned in a first sub-receiving area RA1*a* formed by a first protrusion 211_1 and the first bent portion 212_1 of the first guide portion 210_1, so that the cover glass 1000 may be mounted while being spaced apart from the first protrusion 211_1 and the first bent portion 212_1. In particular, since the upper surface of the first bent portion 212_1 has the height H2_1 sufficient to be spaced apart from the reference line, on which one surface of the support portion 300_1 extends, the first bent portion 212_1 may not come into contact with the mounted cover glass 1000.

In this case, as described above, the height H2_1 of the first bent portion 212_1 may be greater than a first interval H1_1 between the support portions 300_1 in order to prevent one bent side of the cover glass 1000, which is mounted with a predetermined movement range, from coming into contact with the first guide portion 210_1. The description of such configuration is substantially the same as described above, and thus, repeated descriptions thereof will be omitted.

Meanwhile, the cover glass tray 10 may include a larger number of rows RL in which the receiving areas RA are formed.

Figure 11:
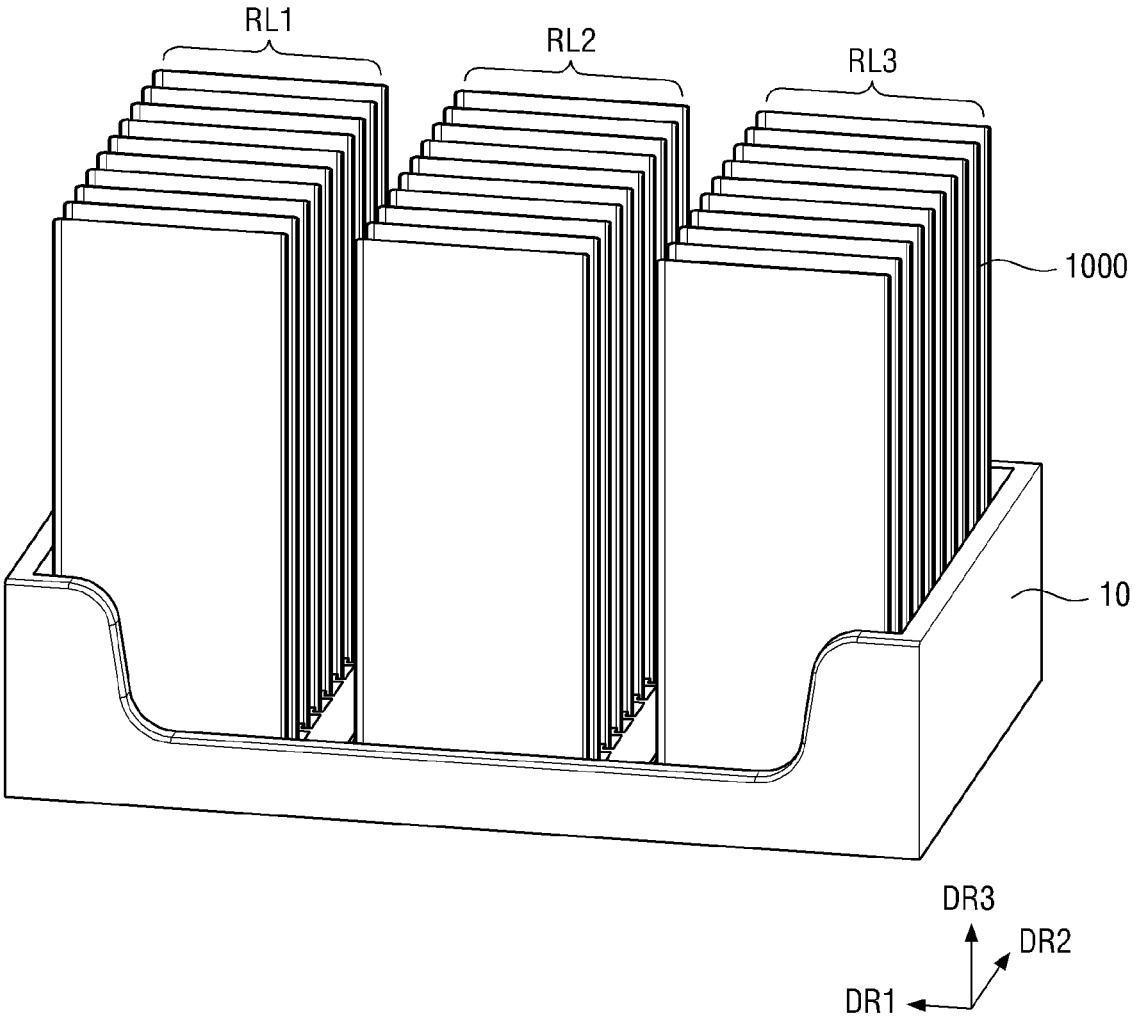
FIG. 11 is a perspective view of the cover glass tray according to another exemplary embodiment.
Figure 12:
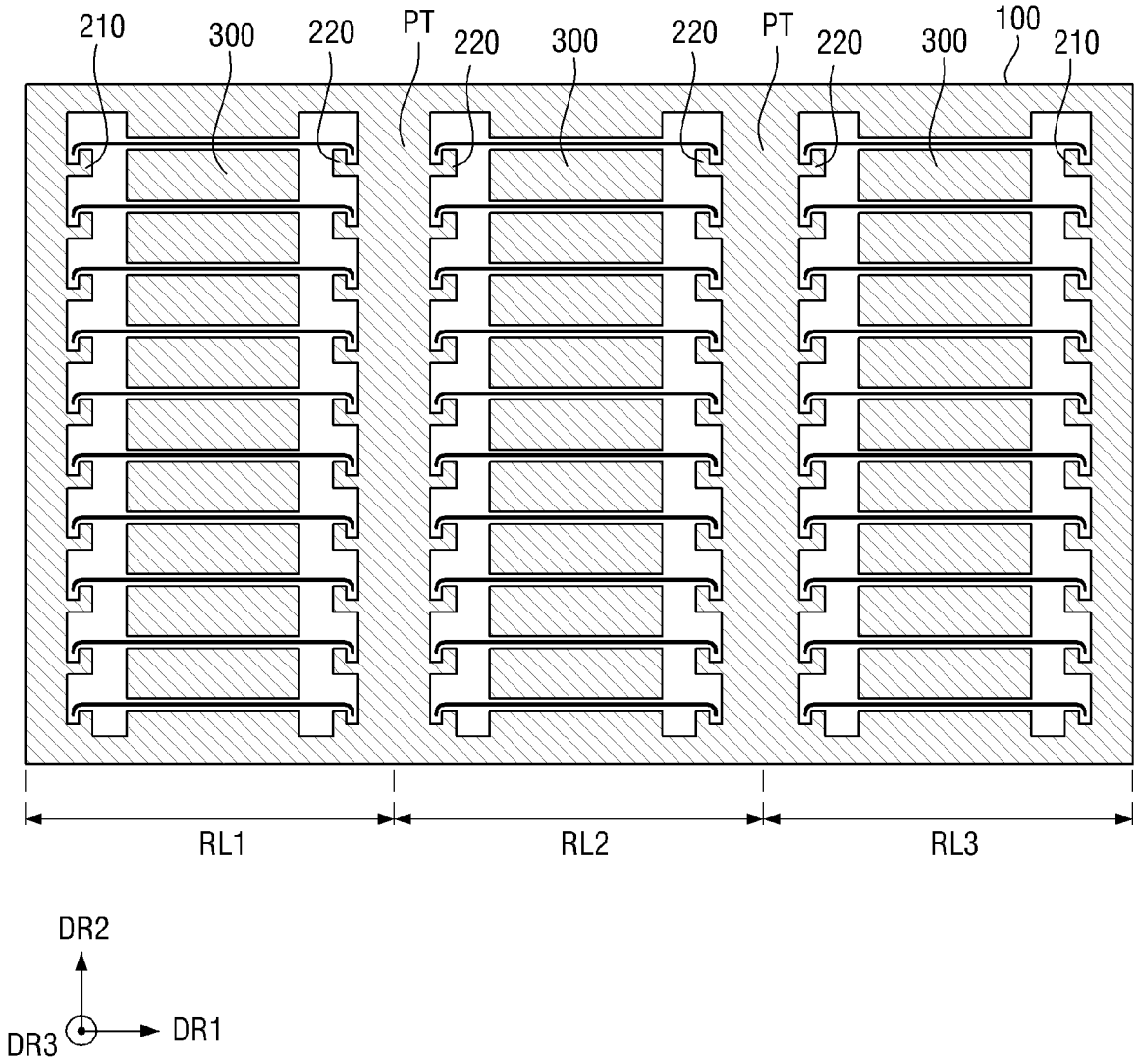
FIG. 12 is a schematic planar view of the cover glass tray of FIG. 11.

FIG. 11 is a perspective view of the cover glass tray according to another exemplary embodiment. FIG. 12 is a schematic planar view of the cover glass tray shown in FIG. 11.

The cover glass tray 10 shown in FIGS. 11 and 12 may include a plurality of rows RL, in which the receiving areas RA are formed, corresponding to a larger number of partition walls PT, support portions 300, and second guide portions 220. The cover glass tray 10 according to the illustrated exemplary embodiment is different from that shown in FIG. 4, in that the cover glass tray 10 includes three rows RL1, RL2, and RL3, in which the receiving areas RA are formed. Hereinafter, the description will be focused on the differences between the cover glass trays, and repeated descriptions as to substantially the same elements will be omitted.

Referring to FIGS. 11 and 12, the cover glass tray 10 may include a plurality of rows RL, in which receiving areas RA are formed, corresponding to a larger number of partition walls PT. The cover glass tray 10 of FIG. 10 may include a first row RL1, a second row RL2, and a third row RL3, where the receiving areas RA are formed. The receiving areas RA formed in the first row RL1 and the third row RL3 may be formed in areas where the first guide portion 210, the second guide portion 220, and the support portion 300 are spaced apart from each other. The receiving areas RA formed in the second row RL2 may be formed in areas where the second guide portion 220, the support portion 300, and the other second guide portions 220 are spaced apart from each other. The cover glass tray 10 may be formed with a plurality of receiving areas RA by designing the number of the partition walls PT and the support portions 300 according to the number of the cover glasses 1000 used for transportation and storage. As shown in FIG. 4, only two rows RL, in which the receiving areas RA are formed, may be provided corresponding to one partition wall PT. However, as shown in FIG. 11, three or more rows RL, in which the receiving areas RA are formed, may be provided corresponding to two or more partition walls PT.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A cover glass tray comprising:

a body portion having a lower surface extending along a first direction and a second direction;

a first guide portion disposed on the lower surface of the body portion;

a second guide portion spaced apart from the first guide portion and facing the first guide portion in the first direction; and a support portion disposed between the first guide portion and the second guide portion, and having one surface extending in the first direction, wherein:

the first guide portion includes a first protrusion extending in the first direction and a first bent portion bent from one end of the first protrusion in the second direction;

the second guide portion includes a second protrusion extending in the first direction and a second bent portion bent from one end of the second protrusion in the second direction; and the first bent portion is disposed between the first protrusion and the second guide portion along the first direction.

2. The cover glass tray of claim 1, wherein an upper surface of each of the first and second protrusions is spaced apart from a reference line extending from the one surface of the support portion.

3. The cover glass tray of claim 2, wherein an upper surface of each of the first and second bent portions is positioned on the same line as the reference line.

4. The cover glass tray of claim 2, wherein an upper surface of each of the first and second bent portions is spaced apart from the reference line.

5. The cover glass tray of claim 2, wherein:

the support portion includes a first support portion and a second support portion spaced apart from each other along the second direction; and a first interval between the first support portion and the second support portion is less than a second interval between an upper surface of the first bent portion and the upper surface of the first protrusion.

6. The cover glass tray of claim 5, wherein:

the first support portion and the second support portion defines a receiving area therebetween; and a cover glass having at least one bent side is configured to be mounted in the receiving area.

7. The cover glass tray of claim 6, wherein the one bent side of the cover glass is configured to be disposed above the first protrusion of the first guide portion to be spaced apart from the first protrusion.

8. The cover glass tray of claim 1, wherein:

the body portion includes an outer wall surrounding the lower surface;

the outer wall includes a first outer wall and a third outer wall extending in the first direction, and a second outer wall and a fourth outer wall extending in the second direction; and the first protrusion of the first guide portion is formed on the second outer wall.

9. The cover glass tray of claim 8, further comprising a partition wall formed on the lower surface of the body portion and extending in the second direction between the first outer wall and the third outer wall, wherein the second protrusion of the second guide portion is formed on the partition wall.

10. The cover glass tray of claim 9, wherein the support portion is formed in plural, each being disposed between the second outer wall and the partition wall, and between the partition wall and the fourth outer wall.

11. A cover glass tray for mounting a cover glass having at least one bent side thereon, the cover glass tray comprising:

a body portion having a lower surface extending in a first direction and a second direction, and including a first outer wall formed on one side of the lower surface along the second direction;

a plurality of support portions arranged on the lower surface to be spaced apart from each other in the second direction; and a first guide portion including a first protrusion protruding from the first outer wall and a first bent portion bent from one end of the first protrusion in the second direction, the first guide portion being spaced apart from the corresponding support portion, wherein the first bent portion is disposed between the first protruding portion and the corresponding support portion in the first direction, and wherein the cover glass is configured to be mounted between the plurality of support portions, such that the one bent side of the cover glass is positioned above the first protrusion of the first guide portion.

12. The cover glass tray of claim 11, wherein the one bent side of the cover glass is configured to be positioned between the first outer wall and the first bent portion, while being spaced apart from the first protrusion.

13. The cover glass tray of claim 12, wherein the first bent portion is spaced apart from the first outer wall, such that the cover glass is configured to be mounted with an interval between one side of the cover glass and the first outer wall less than an interval between the one side of the cover glass and the first bent portion.

14. The cover glass tray of claim 13, wherein the first bent portion is spaced apart from the first outer wall, such that the cover glass is configured to be mounted with a printed layer disposed on a first surface of the one bent side of the cover glass facing the first bent portion while being spaced apart from the first bent portion.

15. The cover glass tray of claim 12, wherein the first protrusion is formed on the first outer wall, such that the cover glass is configured to be mounted with an interval between one side of the cover glass and the first protrusion greater than half of an interval between the plurality of support portions.

16. The cover glass tray of claim 15, wherein the first bent portion is bent from the one end of the first protrusion, such that the cover glass is configured to be mounted with an interval between an upper surface of the first protrusion of the first guide portion and an upper surface of the first bent portion greater than a width of a bent portion of the one bent side of the cover glass.

17. The cover glass tray of claim 11, further comprising:

a second outer wall disposed on the lower surface of the body portion and opposing the first outer wall in the first direction; and a second guide portion spaced apart from the corresponding support portion, and including a second protrusion protruding from the second outer wall and a second bent portion bent from one end of the second protrusion, wherein the other bent side of the cover glass is configured to be positioned above the second protrusion of the second guide portion.

18. The cover glass tray of claim 17, wherein the second bent portion is spaced apart from the second outer wall, such that the cover glass is configured to be mounted with the other bent side thereof being spaced apart from the second protrusion and positioned between the second outer wall and the second bent portion.

19. The cover glass tray of claim 18, wherein the second bent portion is spaced apart from the second outer wall, such that the cover glass is configured to be mounted with a printed layer disposed on a first surface of the other bent side of the cover glass facing the second bent portion while being spaced apart from the second bent portion.

20. The cover glass tray of claim 18, wherein the first bent portion of the first guide portion and the second bent portion of the second guide portion are spaced apart from each other, such that an interval therebetween is less than a width between the one side and the other side of the cover glass.

* * * * *